US006276969B1

(12) United States Patent
Unno et al.

(10) Patent No.: US 6,276,969 B1
(45) Date of Patent: Aug. 21, 2001

(54) TERMINAL CONNECTOR FOR SEALED ELECTROMOTIVE COMPRESSORS

(75) Inventors: Mitsuru Unno, Mishima; Tatsuhiko Satoh, Susono; Hideharu Furukawa, Mishima, all of (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/658,082

(22) Filed: Sep. 11, 2000

(30) Foreign Application Priority Data

Sep. 17, 1999 (JP) ..... 11-263268

(51) Int. Cl.[7] ..... H01R 13/68
(52) U.S. Cl. ..... 439/621; 361/22
(58) Field of Search ..... 439/621, 622, 439/249, 250, 830, 698; 361/22, 23, 24, 25, 93, 115, 103

(56) References Cited

U.S. PATENT DOCUMENTS 4,791,329 * 12/1988 Ubukata et al. ..... 310/68
5,118,260 * 6/1992 Fraser, Jr. ..... 417/18
5,515,217 * 5/1996 Higashikata et al. ..... 361/22
5,685,679 * 11/1997 Sugiura ..... 411/104
5,903,418 5/1999 Boivin et al. ..... 361/22
6,030,257 * 2/2000 Furuya ..... 439/621

* cited by examiner

*Primary Examiner*—Tulsidas Patel
(74) *Attorney, Agent, or Firm*—Russell E. Baumann; Frederick J. Telecky, Jr.

(57) ABSTRACT

A terminal connector (10, 60, 80, 100, 120, 142) for connecting a lead wire to a terminal which is a component of a current path so that the current path will be established. The terminal connector has a lead wire attachment portion (12, 62, 82, 102, 122, 144) which is fixed to the terminal connector with continuity maintained with respect to the lead wire, a terminal mounting portion (13, 63, 83, 103, 123, 143) mounted on the terminal, a fuse portion (14, 64, 84, 104, 124, 145) which electrically connects the lead wire fixing portion and the terminal mounting portion to each other and which melts at a predetermined overcurrent, and a reinforcement portion (15, 85, 105, 125, 146) which protects the fuse portion against external forces.

10 Claims, 8 Drawing Sheets

FIG 1(A)
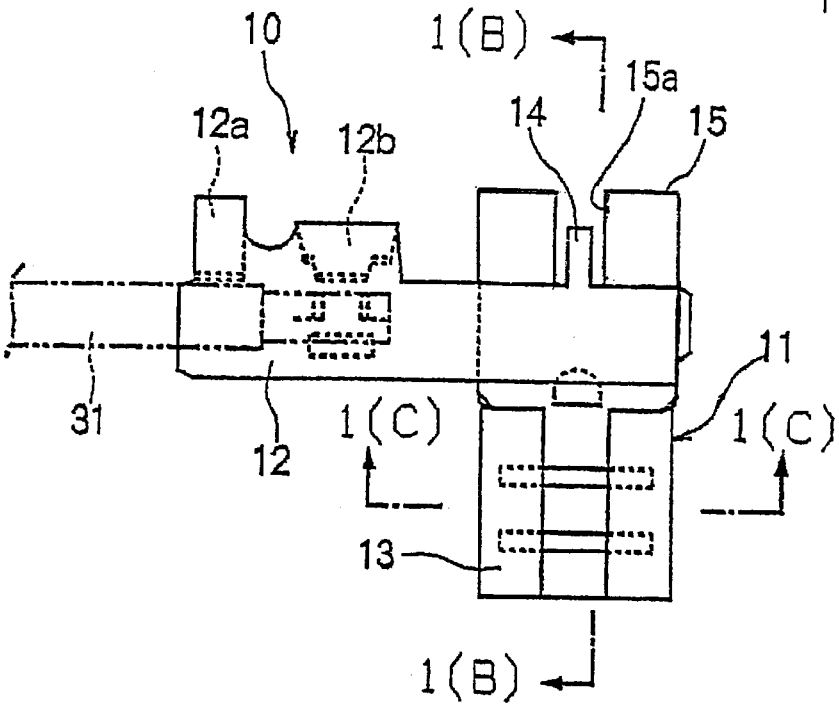
FIG 1(B)
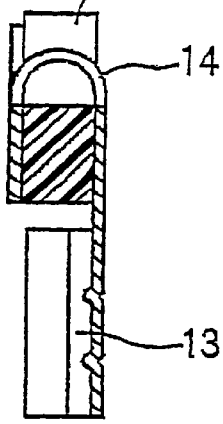
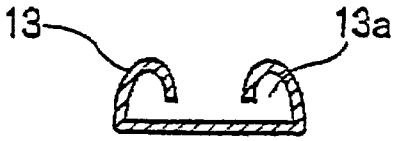
FIG 1(C)

FIG 6(A)
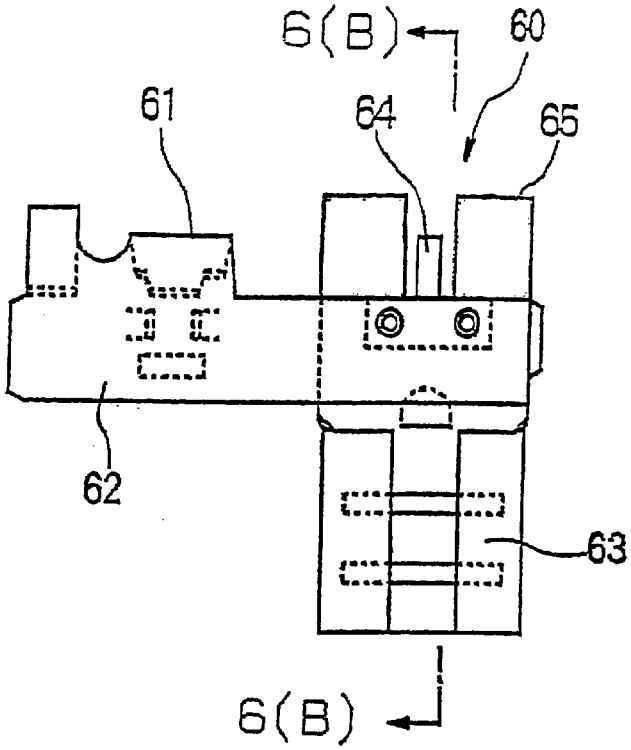
FIG 6(B)
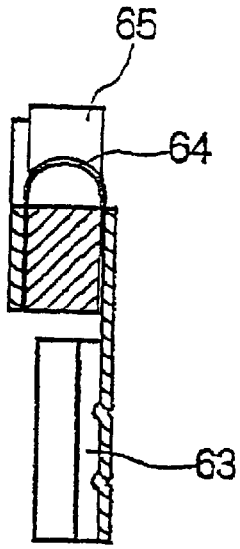
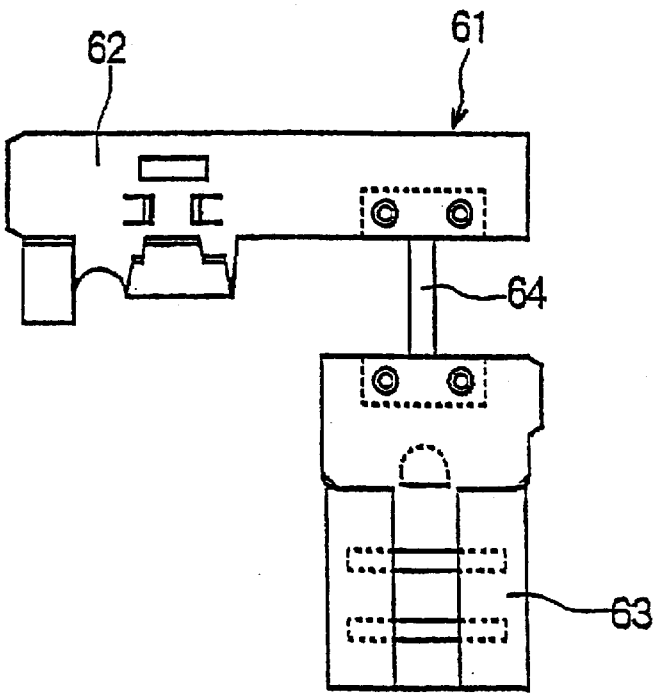
FIG 7

TERMINAL CONNECTOR FOR SEALED ELECTROMOTIVE COMPRESSORS

FIELD OF THE INVENTION

This invention relates generally to terminal connectors for connecting a lead wire that forms a current path to a terminal and more particularly to terminal connectors suitable for mounting on a glass sealed terminal provided in the casing of a sealed electromotive compressor.

BACKGROUND OF THE INVENTION

It is well known to provide protection devices, such as motor protectors, for electromotive compressor motors employed in air conditioners and the like (hereafter also referred to as motor protection device). The motor protection device typically includes movable contacts controlled by a current carrying bimetal element which is actuated by elevated environmental temperatures and/or overcurrents. The motor protection device is typically attached to a motor coil of the compressor motor mounted inside the casing of the electromotive compressor. The motor is connected to an external alternating current power source through the motor protection device, lead wires and glass sealed terminals provided in the casing.

If the electromotive compressor is subjected to an overload or a locked rotor condition due to abnormal circumstances, the environmental temperature inside the casing rises and/or the amount of electric current that passes through the motor protection device rises, the motor protection device then opens the power source circuit by actuation of the bimetal element, thereby preventing possible damage in the compressor caused by excessive temperature or overcurrent. When the temperature and current value are restored to the normal state, the motor protection device closes the power circuit once again and restores the power supply to the compressor.

However, if the motor protection device has been used beyond its useful product life, its contacts could weld together with a result that there are cases where an electrically conductive state continues to be maintained even when the electromotive compressor happens to be in a fault condition. In such cases, the temperature of the motor winding rises further and the electrically insulating material on the winding conductors melts, thereby causing short-circuiting between the windings or the glass of the glass seal melts, with the terminal being blown out by the internal pressure in the sealed casing.

SUMMARY OF THE INVENTION

An object of the present invention is the provision of an apparatus which overcomes the prior art limitation described above and which prevents concomitant trouble that the electromotive compressor would encounter in the event that the motor protection device, by exceeding its useful product life, ceases to perform normally.

Briefly, in accordance with the invention, a terminal connector for connecting a lead wire to a terminal in a current path comprises a lead wire attachment portion for attachment to the lead wire in electrically conductive relationship therewith, a terminal mounting portion for mounting on the terminal and a fuse portion which electrically connects the lead wire attachment portion and the terminal mounting portion and which melts at a predetermined overcurrent with a reinforcement member disposed adjacent to the fuse portion to protect the fuse portion against external forces. In certain embodiments, the reinforcement member is formed of electrically insulating material. According to a feature of a preferred embodiment, the reinforcement member is interposed between facing selected surfaces of the lead wire attachment portion and the terminal mounting portion. According to another feature of a preferred embodiment, the reinforcement member is integrally formed by insert molding the lead wire attachment portion and the terminal mounting portion. According to a feature of the invention, the lead wire attachment portion, the terminal mounting portion and the fuse portion are formed integrally.

Although useful with various electrical equipment, preferably the mounting portion is configured to be mounted on a glass sealed terminal provided through the casing of a sealed electromotive compressor. If desired, the terminal mounting portion can be configured to be mounted on the terminal portion that protrudes outwardly from the casing of a glass sealed terminal and the lead attachment portion can be configured to be attached to the lead wire from the alternating current power source of the sealed electromotive compressor. The terminal mounting portion can also be configured to be mounted on the glass sealed terminal part that protrudes inwardly into the interior of the casing and the lead wire attachment portion can be configured to be attached to the lead wire from the electromotive compressor inside the casing. In the latter instance, it is preferable that the lead wire attachment portion be attached to the lead wire from the motor protection device provided in the electromotive compressors inside the casing.

The invention further relates to a motor protection device that is to be mounted in the casing of a sealed electromotive compressor, the device comprising a lead wire for connection to the glass sealed terminal through the terminal connector at the distal tip end of the lead wire. The invention further relates to a glass sealed terminal that is to be mounted in the casing of a sealed electromotive compressor that is equipped with the terminal connector.

BRIEF DESCRIPTION OF THE DRAWINGS

The accompanying drawings which are incorporated in and constitute part of the specification, illustrate preferred embodiments of the invention and, together with the description, serve to explain the objects, advantages and principles of the invention. In the drawings:

FIG. 1(A) is a front elevational view of a terminal connector made in accordance with a first embodiment of the invention;

FIG. 1(B) is a cross sectional view taken on line 1(B)—1(B) in FIG. 1(A);

FIG. 1(C) is a cross sectional view taken on line 1(C)—1(C) in FIG. 1(A);

FIG. 6(A) is a front elevational view and FIG. 6(B) is a cross sectional view taken on line 6(B)—6(B) of FIG. 6(A), respectively, of a terminal connector made in accordance with another embodiment of the invention;

FIG. 7 is a front elevational view similar to FIG. 2(A) showing the FIG. 6(A) terminal connector body prior to completion;

DETAILED DESCRIPTION OF PREFERRED EMBODIMENTS

The embodiments of the invention to be described below refer to mounting the terminal connector made in accordance with the invention on a glass sealed terminal of a sealed electromotive compressor. However, it is within the purview of the invention that the terminal connector can be used for various other equipment which will become clear in the following description.

Figure 2A:
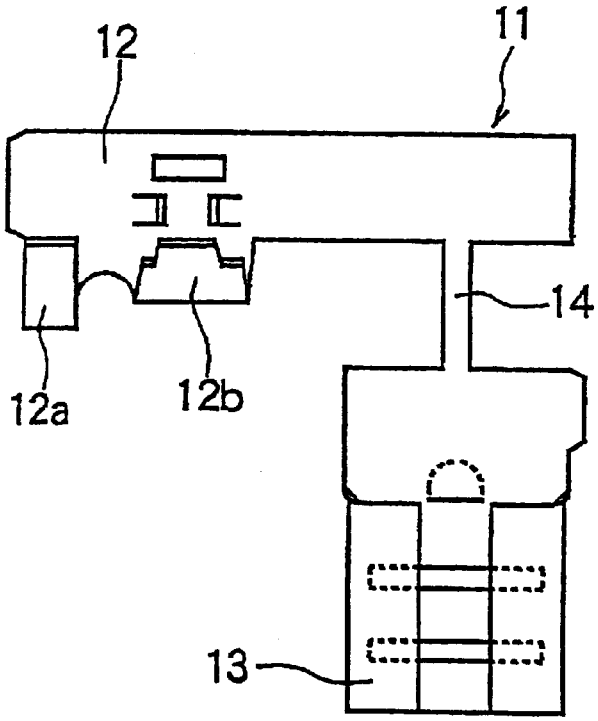
FIG. 2(A) is a front elevational view of the terminal connector body prior to its completion.
Figure 2B:
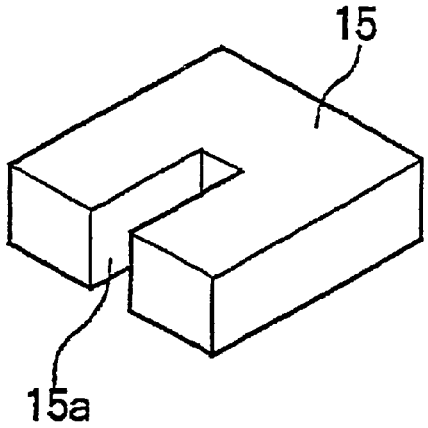
FIG. 2(B) is a perspective view of a reinforcement member used in the FIG. 1(A) terminal connector.
Figure 3:
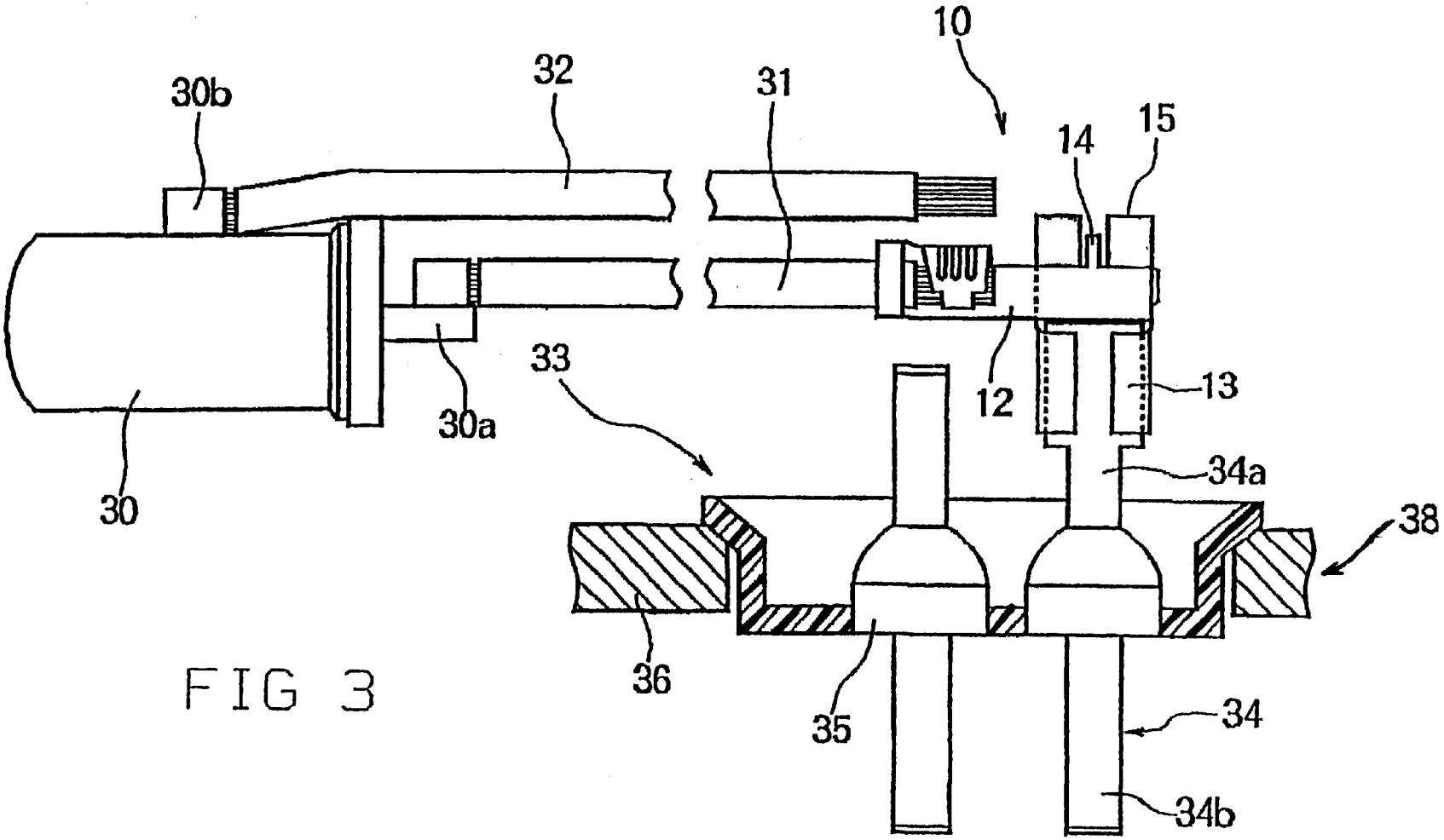
FIG. 3 is a front elevational view of the FIG. 1(A) terminal connector mounted on a terminal within a compressor casing showing the broken away casing and glass terminal assembly in cross section.

With reference to FIGS. 1(A) through 4 which relate to a terminal connector according to the first embodiment, terminal connector 10 basically comprises a terminal connector body 11 made of suitable electrically conductive material and a reinforcement member 15 made of an electrically insulative material. Terminal connector body 11 makes it possible to connect the lead wire from a motor protection device to a glass sealed terminal inside the casing of a sealed electromotive compressor as will be described below. Connector terminal body 11 is made by punching a sheet of metal such as brass or the like, with various portions being suitably bent. It comprises a lead wire attachment portion 12 for clamping a lead wire, such as a Freon resistant wire from the motor protection device, a terminal mounting portion 13 for mounting on the glass sealed terminal, and a fuse portion 14. Lead wire attachment portion 12 attaches terminal connector 10 to a lead wire 31 from motor protector 30. For this purpose, lead wire attachment portion 12 has a lead clamping portion 12*a* that clamps and attaches to the electrically insulative covering of lead wire 31 and a lead wire clamping portion 12*b* that clamps the electrically conductive part that is exposed at the distal tip end of the lead wire, thereby guaranteeing electrical connection with the lead wire, as illustrated in FIG. 3. Known F clamps, O clamps, etc., can be employed for clamping lead wire 31. Terminal mounting portion 13 has a terminal insertion space 13*a* formed by bending opposing sides of portion 13, as shown in FIG. 1(C) so as to receive the terminal blade portion of the glass sealed terminal provided in the casing of the sealed electromotive compressor. As the terminal blade portion is pressed into insertion space 13*a* from the end of the terminal mounting portion 13, terminal connector 10 is electrically and physically connected to the glass sealed terminal. It will be understood that the particular configuration of the lead wire attachment portion 12 and terminal mounting portion 13 can be varied as long as it is attachable to the lead wire and can be mounted on the glass sealed terminal. Fuse part 14 comprises that portion that has been designed to have a prescribed current capacity and is serially connected in the current path connecting lead wire attachment portion 12 and terminal mounting portion 13. If the electric current that passes through the fuse portion 14 exceeds the current capacity, the fuse portion 14 will melt, thereby electrically separating lead wire attachment portion 12 and terminal mounting portion 13. Fuse portion 14 according to this embodiment is bent into a generally U-shaped configuration with lead wire attachment portion 12 having a portion spaced from and facing terminal mounting portion 13.

In the event the motor protection device has been short circuited due to use beyond its useful product life and if excess current flows through the power source circuit so as to cause trouble to the sealed electromotive compressor, fuse portion 14 performs its function (of melting), thereby de-energizing the power source circuit. In designing fuse portion 14, there is a need to take into consideration the time required for the excess current passage to cause melting of the fuse. By adjusting the length and the cross sectional area of fuse portion 14, a suitable fusing time can be chosen for the sealed electromotive compressor. In one example, when the length of the fuse portion made of brass is selected somewhere between three and five millimeters and its cross sectional area is selected in the range between 0.4 and 0.5 square centimeters, fuse portion 14 melts approximately one minute at a current of 100 A and in less than one second at a current of 200 A.

Terminal connector 10 made according to the invention further comprises a reinforcement force isolation member 15 made of electrically insulative material. The reinforcement force isolation member 15 is a recessed block member, as shown in FIG. 2(B), interposed between facing surfaces of lead wire attachment portion 12 and terminal mounting portion 13, as shown in FIGS. 1(A) and 1(B). Reinforcement force isolation member 15 is fixed by suitable means such as by clamping engagement with the opposing surfaces so that it is integral with terminal connector body 11. As a result of this, fuse part 14, whose strength is comparatively low, is protected from possibly damaging forces during assembly or the like. The force isolation capability is enhanced by placing fuse portion 14 inside the recessed portion 15*a* of the reinforcement force isolation member 15. Because of this arrangement, fuse portion 14 is protected from external physical forces. For example, the force applied when terminal fitting 10 is mounted on the glass sealing terminal can be received by reinforcement force isolation member 15. In a suitable example, the reinforcement member 15 is formed of heat-hardenable resin. In another suitable example, it is formed of ceramic material.

As noted above, FIG. 2(A) shows terminal connector body 11 prior to its completion. From this state, fuse portion 14 is bent so that a surface of lead attachment portion 12 faces a surface of terminal mounting portion 13. The reinforcement force isolation member 15, as shown in FIG. 2(B), is interposed between the opposing surfaces, thereby resulting in the completed terminal fitting 10 shown in FIG. 1.

FIG. 3 illustrates terminal connector 10 as it is connected for use in a sealed compressor casing. In other words, this figure shows how the terminal connector is used for the connection of lead wire 31 that comes from motor protection device 30 to glass sealed terminal assembly 33. Motor protection device 30 is mounted in or on the motor windings (not shown in the figure) in the casing of a sealed electromotive compressor. One end of lead wire 31 is connected to terminal 30*a* of motor protection device 30, with terminal connector 10, made according to the invention, being attached at the opposite tip end thereof. A lead wire 32 is connected to the other terminal 30*b* of the motor protection device fixed to a steel housing and this is connected to the windings of the motor. Glass sealed terminal assembly 33 closes an opening formed in casing 36 of a sealed electromotive compressor 38 and includes a terminal 34 for connecting the motor in the casing to an alternating current power source (not shown in the figure) disposed outside the casing. Glass sealed terminal assembly 33 includes terminals such as terminal 34 mounted within the assembly and electrically isolated therefrom by glass 35.

Terminal 34 has an inner blade terminal part 34*a* on the interior side and an external pin terminal part 34*b* on the exterior side. Terminal connector fitting 10 is mounted on the inner terminal part 34*a*. The motor protection device 30 is actuated when the electric current that passes through it or when its environmental temperature has exceeded certain selected values. When a large electric current passes through terminal connector 10, its fuse portion 14 is heated. Because of the physical distance between the motor protection device 30 and terminal connector 10, however, the affect by the heating of the fuse portion on motor protection device 30 is minimal.

Figure 4:
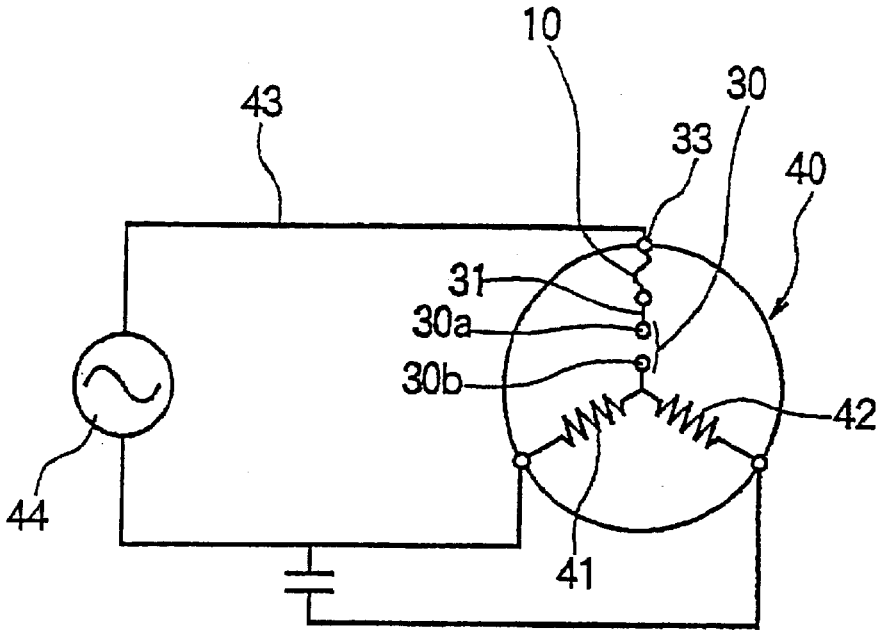
FIG. 4 is a schematic diagram showing a power source circuit of a sealed electromotive compressor that contains the terminal connector of FIG. 1(A)

FIG. 4 is a schematic of the motor drive circuit of a sealed electromotive compressor 40 that includes terminal connector 10 and motor protection device 30. One terminal 30*b* of motor protection device 30 is connected between the main winding 41 and auxiliary winding 42. Terminal connector 10 made according to the invention is connected through lead wire 31 to the other terminal 30*a* of motor protection device 30. Terminal connector 10 is connected through glass sealed terminal assembly 33 and lead wire 43 to an alternating current power source 44 located outside of the casing.

Figure 5:
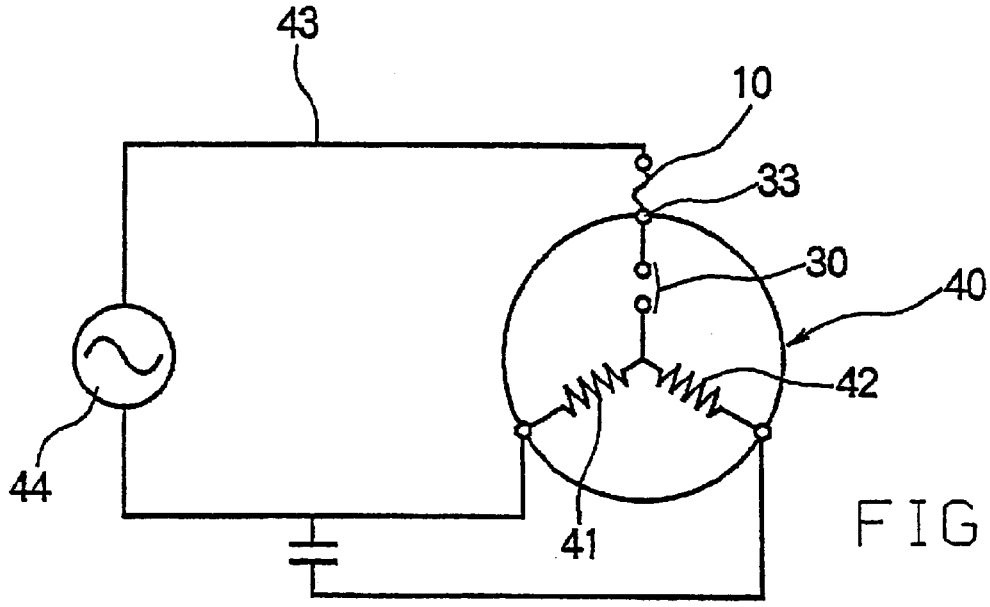
FIG. 5 is a view similar to FIG. 4 but showing a modified mounting arrangement.
Figure 8A:
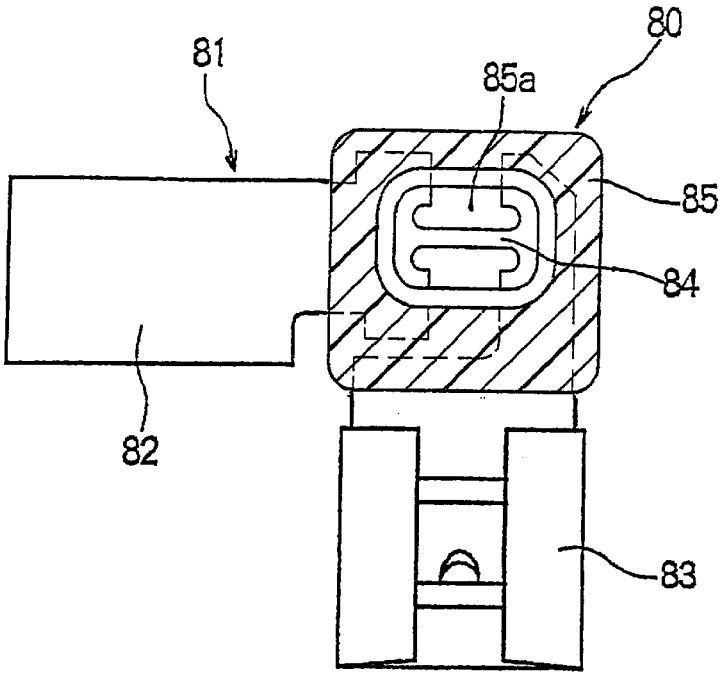
FIG. 8(A) is a front elevational view and FIG. 8(B) is a side elevational view, respectively, of a terminal connector made according to still another embodiment of the invention.
Figure 8B:
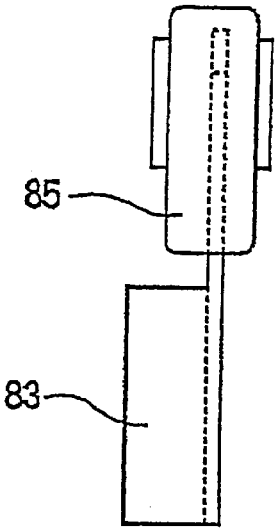
Figure 9A:
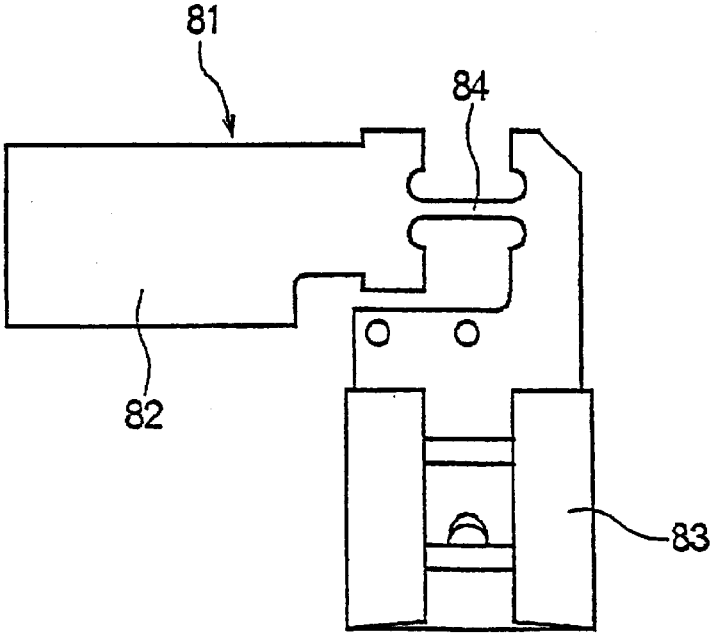
FIG. 9(A) is a front elevational view and FIG. 9(B) is a side elevational view, respectively, of the FIG. 8(A) terminal connector body prior to completion.
Figure 9B:
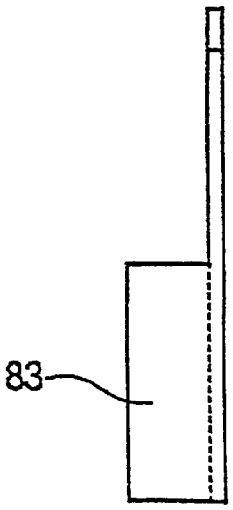

FIG. 5 shows a similar circuit relating to an alternate arrangement for terminal connector 10. In this example, terminal connector 10 is placed outside of sealed electromotive compressor 40. In other words, the lead wire attachment portion 12 of terminal connector 10 is fixed to the lead wire that is connected directly to the alternating current electric power source 44. Terminal mounting portion 13 is mounted on the outside terminal part 34*b* (see FIG. 3) of glass sealing terminal assembly 33. This arrangement becomes possible when there is no problem in exposing the fuse portion 14 outside of the casing of sealed electromotive compressor 40.

FIGS. 6(A), 6(B) and 7 show a modified embodiment of terminal connector 10. Terminal connector 60 comprises fuse portion 64 made of a separate member fixed to lead wire attachment portion 62 and terminal mounting portion 63 of terminal connector body 61 by means of rivets or the like. An advantage provided by the use of a separate member for fuse portion 64 lies in the ability of selecting different materials for terminal body 61 and fuse portion 64 so that it is possible to finely set or change the fuse characteristics of the fuse portion 64, irrespective of the characteristics of the material for the terminal connector body 61.

FIGS. 8(A), 8(B), 9(A) and 9(B) show a terminal connector which relates to another embodiment of the invention. Terminal connector 80 of this embodiment has a generally L-shaped terminal connector body 81, with a fuse portion 84 being formed at the bend of the L-shaped part. Reinforcement force isolation member 85 in this embodiment is a generally block-shaped resin body member integrally formed with terminal connector body 81 by molding in such a fashion as to cover the L-shaped bend but with a window 85*a* exposing fuse portion 84 so that its fused state can be observed through the window. Lead wire attachment portion 82 of terminal connector body 81 and terminal mounting portion 83 are made physically integral with one another and maintained integral even after a melting of the fuse portion by means of the reinforcement force isolation member 85. In addition, reinforcement force isolation member 85 receives external forces in connection with the mounting of the connector on the terminal. In this embodiment, moreover, the attachment of the lead wire to the lead wire attachment portion 82 is effected by welding.

Figure 10:
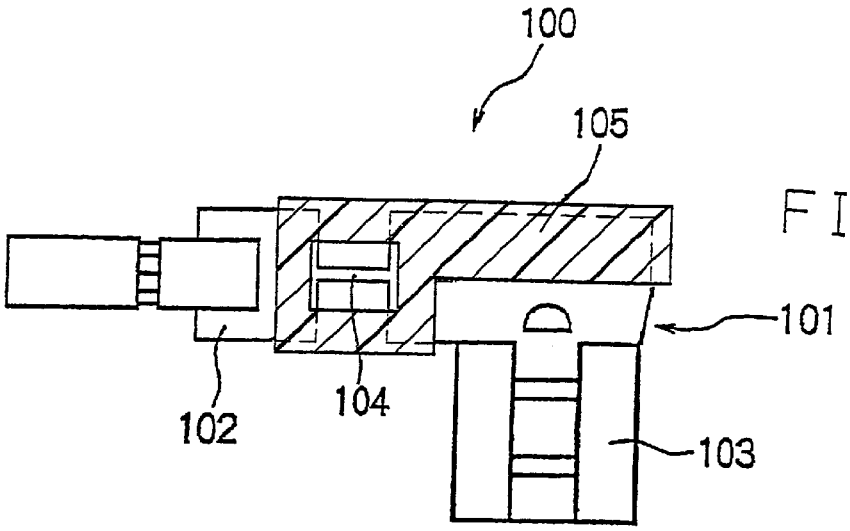
FIG. 10 is a front elevational view of a terminal connector made in accordance with still another embodiment of the invention.
Figure 11:
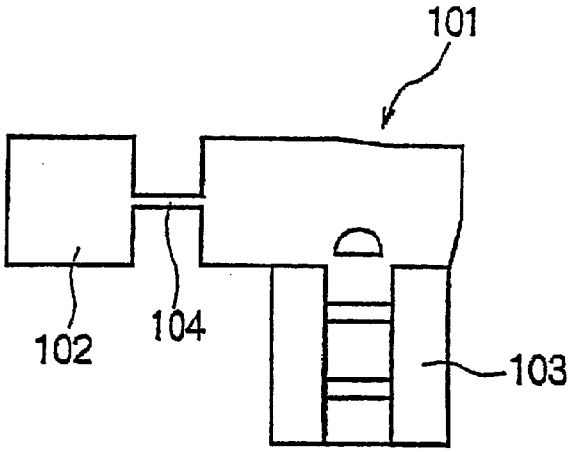
FIG. 11 is a front elevational view of the terminal connector body shown in FIG. 10 prior to the installation of the reinforcement member.

FIGS. 10 and 11 show the terminal connector according to another embodiment of the invention. Terminal connector body 101 of terminal connector 100 according to this embodiment has an external appearance which is similar to the terminal connector body 81 in the previous embodiment; however, it is different in that the arrangement of fuse portion 104 is shifted further toward lead wire attachment portion 102 from the L-shaped bend. Reinforcement force isolation member 105, made integral with terminal connector body 101 by insert molding, circumscribes the fuse portion 104 and, at the same time, extends over the top of terminal mounting portion 103. The extended portion of the reinforcement force isolation member 105 functions as that part which receives external forces during mounting of terminal mounting portion 103 on the glass sealed terminal.

Figure 12:
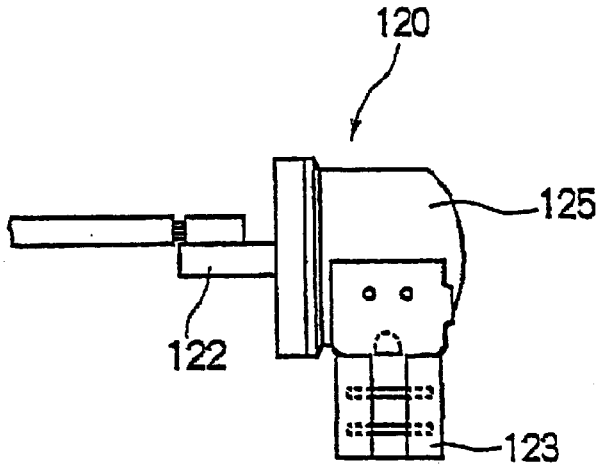
FIG. 12 is a front elevational view of a terminal connector made according to still another embodiment of the invention.
Figure 13:
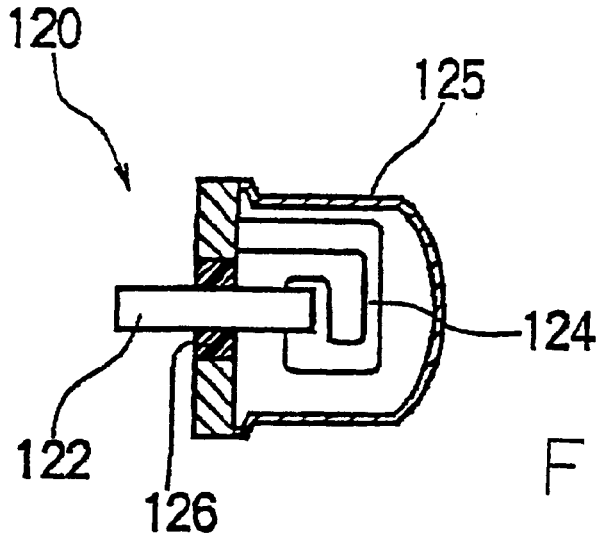
FIG. 13 is a cross sectional view of the terminal connector of FIG. 12.

FIGS. 12 and 13 show a terminal connector relating to yet another embodiment. In this embodiment, the reinforcement force isolation member 125 comprises a casing made of steel for sealing the terminal connector and forms a part of the current path in the terminal connector 120. In other words, terminal connector 120 forms part of an electric current path by means of a pin-shaped lead wire attachment portion 122, fuse portion 124, casing shaped reinforcement force isolation member 125 and terminal mounting portion 123 welded to the outside of reinforcement force isolation member 125. Reinforcement force isolation member 125 and lead wire attachment portion 122 are electrically isolated from each other by means of glass seal 126. The casing shaped reinforcement force isolation member 125 completely covers fuse portion 124, with a result that external influences on the fuse portion 126 is minimized.

Figure 14:
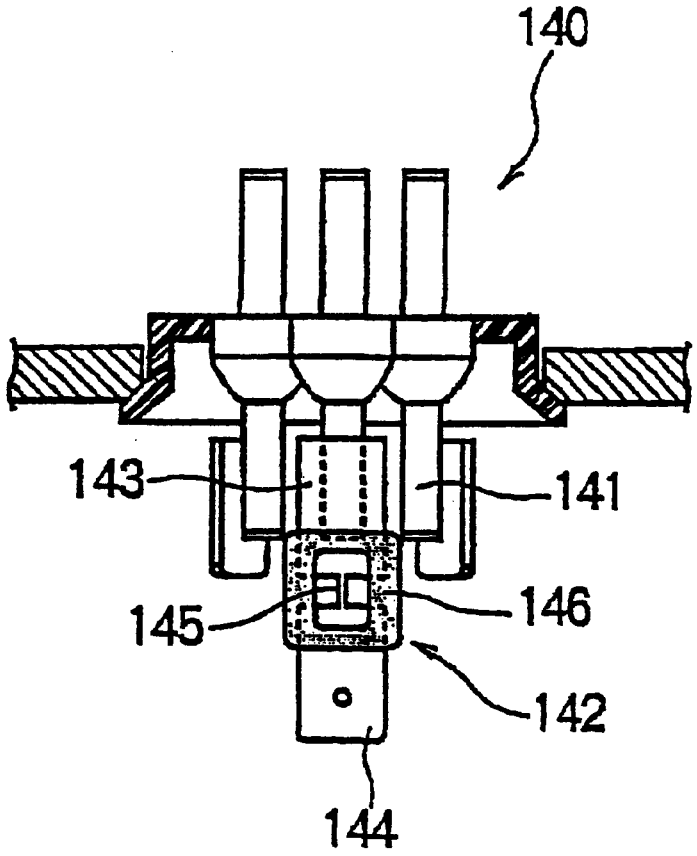
FIG. 14 is a cross sectional view of a broken away portion of a compressor casing and glass terminal assembly showing an embodiment in which a terminal connector made in accordance with the invention is formed integrally with a glass sealed terminal of the compressor casing.

FIG. 14 shows an embodiment in which a glass sealed terminal is integrally connected to a terminal connector made in accordance with the invention. The glass seal terminal assembly 140 has a terminal connector 142 integrally connected at the tip of an internal terminal part 141. Terminal connector 142 is fixed thereto by welding terminal mounting blade portion 143 to the inner terminal part 141. Terminal connector 142 has a lead wire attachment portion 144 as in the previously described embodiments. A fuse portion 145 is formed between lead wire attachment portion 144 and terminal mounting portion 143. Reinforcement force isolation member 146, made of an electrically insulating material, covers fuse portion 145 by insert molding as in the FIGS. 8(A), 8(B) embodiment and becomes integral with it. The basic operation of the terminal fitting 120 in this embodiment is the same as in the case of each embodiment previously described.

According to the invention explained above, protection of a circuit against overcurrent can be realized by using an extremely simple construction. With a terminal connector having a fuse portion protected by the reinforcement force isolation member made according to the invention, it becomes possible to prevent the occurrence of an accident that will change the characteristics of the fuse portion by producing a deformation of the fuse portion when it is mounted onto the terminal. In particular, as a result of the invention, it is possible to prevent various possible problems of the electromotive compressor that could occur when the motor protection device has exceeded its product life and no longer operates as intended.

It will be understood that in view of the above description and drawings, variations and modifications will be apparent to those skilled in the art. It is the intention that the appended claims be interpreted as broadly as possible, in view of the prior art, to include all such variations and modifications.

What is claimed:

1. A terminal connector system for connecting a motor protector for use with a sealed electromotive compressor to a terminal in a current path comprises a lead wire connected at one end to the motor protector and a terminal connector comprising a lead wire attachment portion for attachment to other end of the lead wire in electrically conductive relationship therewith, a terminal mounting portion for mounting on the terminal, a fuse portion which electrically connects the lead wire attachment portion and the terminal mounting portion and which melts at predetermined overcurrent and ambient temperature conditions and a reinforcement member disposed adjacent to the fuse portion to protect the fuse portion against external forces.

2. A terminal connector system according to claim 1 in which the reinforcement member is formed of electrically insulating material.

3. A terminal connector system according to claim 1 in which the reinforcement member is integral with the lead wire attachment portion and the terminal mounting portion.

4. A terminal connector system according to claim 2 in which the lead wire attachment portion and the terminal mounting portion each have a selected surface which face each other and the reinforcement member is interposed between and clamped by the selected surfaces.

5. A terminal connector system according to claim 2 in which the reinforcement member encapsulates at least a portion of both the lead wire attachment portion and the terminal mounting portion.

6. A terminal connector system according to claim 1 in which the lead wire attachment portion, the terminal portion and the fuse portion are integrally formed.

7. A terminal connector system according to claim 1 in which the sealed electromotive compressor includes a casing and the terminal mounting portion is configured to be mounted on a terminal portion which protrudes outwardly from the casing of a glass sealed terminal and the lead wire attachment portion is configured to be fixed to a lead wire from a alternating current power source of the sealed electromotive compressor.

8. A terminal connector system according to claim 7 in which the terminal mounting part is configured to be mounted on a terminal portion which protrudes inwardly into the casing of the glass sealed terminal and the lead wire attachment portion is electrically connected to the electromotive compressor.

9. A terminal connector system according to claim 1 in which said sealed electromotive compressor is enclosed by a casing with a glass sealed terminal extending through the casing and having a terminal portion within the casing, the terminal mounting portion of the terminal connector being welded to the glass sealed terminal portion.

10. A terminal connector for connecting a lead wire to a terminal in a current path comprising a lead wire attachment portion for attachment to the lead wire in electrically conductive relationship therewith, a terminal mounting portion for mounting on the terminal, a fuse portion which electrically connects the lead wire attachment portion and the terminal mounting portion and which melts at predetermined overcurrent and ambient temperature conditions and a reinforcement member of electrically insulating material disposed adjacent to the fuse portion to protect the fuse portion against external forces, the lead wire attachment portion and the terminal mounting portion each have a selected surface which face each other and the reinforcement member is interposed between and clamped by the selected surfaces.

* * * * *